United States Patent [19]

Isobe et al.

[11] 4,433,926

[45] Feb. 28, 1984

[54] PRINTER HEAD

[75] Inventors: Minoru Isobe; Hiroshi Kikuchi; Minoru Teshima, all of Tokyo; Tadasi Kodama, Sakura; Mitsuo Iwama, Yokosuka, all of Japan

[73] Assignees: Oki Electric Industry Co., Ltd.; Nippon Telegraph & Telephone Public Corporation, both of Tokyo, Japan

[21] Appl. No.: 404,035

[22] Filed: Aug. 2, 1982

Related U.S. Application Data

[63] Continuation of Ser. No. 179,834, Aug. 20, 1980, abandoned.

[30] Foreign Application Priority Data

Sep. 3, 1979 [JP] Japan ..... 54-111700

[51] Int. Cl.[3] ..... B41J 3/12

[52] U.S. Cl. ..... 400/124; 101/93.05

[58] Field of Search ..... 400/124; 101/93.05; 269/254 R

[56] References Cited

U.S. PATENT DOCUMENTS

| | | | |
|---|---|---|---|
| 3,896,918 | 7/1975 | Schneider | 400/124 |
| 3,897,865 | 8/1975 | Darwin et al. | 400/124 |
| 3,941,051 | 3/1976 | Barrus et al. | 101/93.04 |
| 4,010,836 | 3/1977 | Bernardis et al. | 400/124 |
| 4,225,250 | 9/1980 | Wagner et al. | 400/124 |
| 4,252,449 | 2/1981 | Miyazawa et al. | 400/124 |

*Primary Examiner*—Paul T. Sewell

*Attorney, Agent, or Firm*—Armstrong, Nikaido, Marmelstein & Kubovcik

[57] ABSTRACT

A printer head having a circular first yoke, a cylindrical permanent magnet fixed on the circular first yoke, a (n) number of electromagnets (n is an integer) positioned on a circle on the first yoke within the permanent magnet having predetermined angle intervals, a ring shaped second yoke fixed on the permanent magnet so that the upper surface of the second yoke is on the same plane as that of the upper surface of the electromagnets, a ring shaped spacer positioned on the second yoke, a disk shaped spring fixed on the spacer having a common outer ring and a (n) number of projections projected in the internal direction from the common outer ring, (n) number of armatures each fixed on each projection of the spring, (n) number of print needles each fixed to each armature so that a print needle is perpendicular to the plane of the spring, a circular yoke plate fixed on the spring having (n) number of radial slits for accepting the armatures and the width of each slit being narrower than the width of projection of the spring, a guide frame fixed on the yoke plate having a ring and a hollow cylindrical post positioned at the center of the ring, the post having a guide slit at the top of the guide frame for accepting the tops of the aligned print needles, a side hole at the side of the post at the extension of the guide slit being provided. And an oil felt being provided on the inner wall of the permanent magnet.

3 Claims, 10 Drawing Figures

PRINTER HEAD

This is a continuation of application Ser. No. 179,834 filed Aug. 20, 1980, now abandoned.

BACKGROUND OF THE INVENTION

The present invention relates to a structure of a printer head for a dot-printer, in particular, relates to such a printer head which is small in size, having excellent printing quality, can be manufactured through a simple process, and can operate with less power consumption.

FIG. 1 shows the principle of the dot matrix printing in a serial printer. A printer head 100 has eight needles for mosaic printing, and travels along a printing line in the direction of the arrow A. During the travelling, needles are selectively driven to hit a paper through an ink ribbon and a desired pattern "A", "B", "C" or "D" is printed. The selection of needles is controlled by the content of an integrated circuit (IC) memory. When the size of a character to be printed is 2.67 mm×2.05 mm, 7×5 number of dots are enough for printing a recognizable character.

The prior needle dot head for dot printing process is shown in the U.S. Pat. No. 3,896,918, in which an electromagnetic drive for the operation of printing needles of a mosaic printing head includes a pivotally mounted armature for each needle which are arranged along circular arc. The construction includes a common yoke for all of the electromagnets which comprises two concentric cups or walls forming a single unit with cylindrical cores arranged at equal intervals along a circular arc parallel to the genatrix of the cup and located between the individual yoke cups.

However, said prior printing head has the disadvantages that the power consumption for driving needles is large, the size of the apparatus is large, and the operational speed of the printer is rather slow. Those disadvantages come mainly from the fact that a needle is driven by an electromagnet, and all the printing power for striking a paper by a needle is given by said electromagnet.

The present inventors have proposed a printing head for a dot printer for overcoming said disadvantages in Japanese Patent Application No. 56924/79, 56925/79 and 62143/79 (corresponding U.S. application Ser. No. 147,106, U.K. Application No. 8,014,271, West Germany Application No. P 30 17 903.4). That printer head comprises of a cylindrical permanent magnet, a first yoke covering the bottom of the permanent magnet, a plurality of electromagnets each positioned on a circle on said first yoke with the predetermined angle intervals, a disk shaped spring having an outer ring and a plurality of projections towards the center of the disk, a plurality of armatures each attached to the related projection of said disk spring, a plurality of print needles each attached to the related projection of said disk spring so that each of the needles has the perpendicular component to the disk spring plane, a ring shaped spacer positioned between the disk spring and said cylindrical permanent magnet, a second yoke for providing a magnetic flux path between the permanent magnet and each of the electromagnets, and a guideframe having a thin linear slit for arranging the top of said needles and covering the needles.

The present invention is the improvement of that proposed printing head, and has the advantages that the manufacturing process is simple, the manufacturing cost is low, and the operational life time is long.

SUMMARY OF THE INVENTION

It is an object, therefore, of the present invention to overcome the disadvantages and limitations of a prior printer head by providing a new and improved printer head.

It is also an object of the present invention to provide a printer head which is small in size, operates with a small power consumption, has a simple manufacturing process, and has a long life term.

The above and other objects are attained by a printer head for a dot printer comprising; a circular first yoke; a cylindrical permanent magnet fixed on said circular first yoke; a (n) number of electromagnets each having a center core and a coil wound around the core positioned on a circle on said first yoke within said permanent magnet with the predetermined angle intervals; a ring shaped second yoke fixed on the permanent magnet so that the upper surface of the second yoke is on the same plane as that of the upper surface of the cores of said electromagnets; a ring shaped spacer positioned on said second yoke; a disk shaped spring having a common outer ring and a (n) number of projections projected in the internal direction from said common outer ring; (n) number of substantially rectangular parallelepiped armatures each fixed on each projection of said spring; (n) number of print needles each fixed to each armature so that a print needle is perpendicular to the plane of the spring; a circular yoke plate fixed on the spring, having (n) number of radial slits for accepting said armatures, and the width of each slit being narrower than the width of a projection of said spring, a guide frame fixed on said yoke plate having a ring and a hollow substantially cylindrical post positioned at the center of said ring, said post having a guide slit at the top of the post for accepting the tops of the aligned print needles, and a side hole at the side of the guide at the extension of the guide slit; and a cylindrical oil felt provided on the inner wall of said permanent magnet.

The presence of the oil felt and the side hole on the guide frame are the important features of the present invention. The oil felt provides oil to the spring to reduce the friction of the spring, and then, the life time of the printer itself is increased, through this feature, the operational noise of a printer is decreased. Due to the presence of the side hole on the guide frame, the alignment of the print needles is performed very simply, and thus, the manufacturing process of the printer is simplified.

BRIEF DESCRIPTION OF THE DRAWINGS

The foregoing and other objects, features, and attendant advantages of the present invention will be become better understood by means of the following description and accompanying drawings wherein;

FIGS. 4A through 4G show components and the assembling process of the present printer head.

DESCRIPTION OF THE PREFERRED EMBODIMENTS

Figure 1:
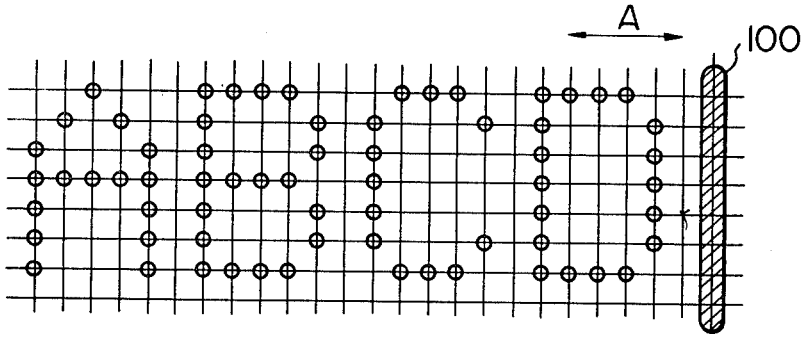
FIG. 1 shows a mosaic pattern for the explanation of the dot matrix printing of the present invention.

In FIGS. 2, 3 and 4A through 4G, the reference numeral 1 is a disk shaped first yoke made of ferromagnetic material having a central hole 1*a* and a plurality of small pin holes 1*b* distributed with the predetermined angle intervals on a circle. Said hole 1*a* is provided for passing through lead lines of the printer head. Preferably, the number of said small holes 1*b* is eight, which is the same as the number of print needles. The reference numeral 2 is a column shaped core made of preferably silicon steel which operates as a magnetic core of an electromagnet. A column core 2 has a thin short pin 2*a*, which is inserted into a small hole 1*b* on the first yoke 1 to fix the core 2 on the yoke 1 by caulking the pin. The reference numeral 3 is a cylindrical permanent magnet magnetized in the axial direction, and is preferably made of ferrite material. The permanent magnet 3 is fixed on the yoke 1, by preferably an adhesive process. The reference numeral 4 is a coil wound on said core 2, and lead lines of the coil 2 are connected to an external circuit through said center hole 1*a* of the first yoke 1. The reference numeral 5 is a ring shaped second yoke having a plurality of screw holes 5*a*, and said second yoke 5 is fixed on the permanent magnet 3 through adhesive process. Preferably, the level of the upper surface of the second yoke 5 is the same as the level of the upper surface of the core 2, that is to say, the upper surface of the second yoke 5 is on the same plane as that of the upper surface of the core 2.

The reference numeral 6 is a ring shaped thin spacer made of ferromagnetic material having a plurality of holes 6*a* which coincide with said screw holes 5*a* on the second yoke 5. The thickness of the spacer 6 defines the gap between a paper to be printed and the top of a print needle of the present printer head. That is to say, the stroke of a print needle is defined by the thickness of the spacer 6. The spacer 6 has a ring 6*b* and a plurality of projections 6*c* towards the center of the ring. Preferably, a hole 6*a* is provided at the foot of a projection 6*c*, and when the spacer 6 is put on the second yoke 5, the top 6*c*′ of the projection 6*c* is supposed to extend beyond the inner wall of the second yoke 5.

The reference numeral 7 is a disk shaped spring made of preferably carbon steel, and has common outer ring 7*c* and a plurality of projections 7*a* which project from the common ring 7*c* towards the center of the spring. Each projection 7*a* has a small pin hole 7*b* which coincides with a screw hole 5*a* and hole 6*a*. Therefore, it should be appreciated that each projection 7*a* can be individually biased or curved from the common ring 7*c*. The reference numeral 8 is an armature which is fixed at the extreme end of the projection 7*a* of said 7 through the spot welding process. An armature 8 is a substantially elongated rectangular parallelepiped, but the one of the extreme ends is sharpened as shown in the drawings so that many armatures are mounted at the central narrow area. It should be appreciated that when the armature 8 is selectively attracted by the electromagnet 2, the related projection 7*a* of the spring 7 is biased or curved. The reference numeral 9 is a linear print needle fixed at the narrow edge of the armature 8 by the soldering or the welding process so that the print needle 9 is perpendicular to the plane of the spring 7.

The reference numeral 10 is a yoke plate having a plurality of small holes 10*a* which coincide with the holes 7*b*, 6*a* and 5*a*, and a plurality of slits 10*b* in the radial direction which accepts said armature 8. The width of said slit 10*b* is enough to insert an armature 8 in said slit, but is narrower than the width of a projection 7*a* of the spring 7.

It should be appreciated that the first yoke 1, the second yoke 5, the spacer 6, the spring 7, the armatures 8, the yoke plate 10, and the permanent magnet 3 are made of ferromagnetic material for providing the magnetic path in those components.

The reference numeral 11 is a guide frame having a ring 11*d* and a hollow substantially cylindrical post 11*e*. The ring 11*d* has a plurality of small holes 11*b* which coincide with the holes 10*a*, 7*b*, 6*a* and 5*a*. The post 11*e* has a thin linear guide slit 11*a* on the top cap of the post 11*e* for aligning the tops of the print needles 9, and a side hole 11*c* at the side wall of the post 11*e* at the extension of said slit 11*a*. The side hole 11*c* serves to align the print needles 9 on a straight line. The guide frame 11 having the ring 11*d* and the post 11*e* is preferably made of plastics, for instance, nylon 6 or nylon 66 which is light in weight, thus, the guide frame 11 is manufactured through a moulding process. Preferably the plastics are reinforced by glass fiber. It should be appreciated that the guide slit 11*a* of the guide frame 11 would be subject to friction wear by the quick movement of the print needles in the guide slit 11*a*, and due to the use of the reinforced plastics, that wear is considerably small. Therefore, in spite of the friction wear, no particular material, like hard jewels are not necessary for providing that guide slit 11*a*. Therefore, the use of the reinforced plastics provides a printer with a low manufacturing cost.

The reference numeral 12 shows screws for fixing the guide frame 11, the yoke plate 10, the spring 7 and the spacer 6 to the second yoke 5 through the holes 11*b*, 10*a*, 7*b* and 6*a*.

Further, the reference numeral 13 is a cylindrical oil felt which contains oil, and said oil felt 13 is mounted along the inside wall of the permanent magnet 3. An example of that oil is the trade name KF-100 manufactured by Shinetsu Chemical Industry Inc. in Japan.

In assembling the above components, the sub assemblies A, B and C are first prepared. The first sub assembly A is the guide frame 11 and a plurality of screws 12, which are called a guideframe assembly.

The sub assembly B which is called a needle assembly has a yoke plate 10, a spring 7 together with armatures 8 and print needles 9, and a spacer 6, each of which are shown in FIG. 4A. First, a print needle 9 is welded at the extreme end of an armature 8, and then, the armature 8 together with the print needle 9 are welded on the extreme end of the separated projection 7*a* of the spring 7 (see FIG. 4B(2). Then, the yoke plate 10 is placed on the spring 7 so that each armature 8 is inserted in the related slit 10*b* of the yoke plate 10. The spacer 6 is adhered under the spring 7. In assembling, the sub assembly B, it should be appreciated that the small holes 10*a* of the yoke plate 10, 7*b* of the spring 7, and 6*a* of the spacer 6 must coincide to one another in order to insert screws 12 through those holes.

The sub assembly C which is called a magnet assembly has the first yoke 1, a plurality of cores 2 mounted on the yoke 1 with the predetermined angle intervals, a plurality of coils 4 each wound on the related core, the permanent magnet 3 which is fixed on the first yoke 1 by adhesive means, the second yoke 5 fixed on the permanent magnet 3, and the oil felt 13 inserted in the permanent magnet 3 so that said oil felt 13 surrounds the electromagnets 2 and 4. The assembled sub assembly C is shown in FIG. 4B. In the sub assembly C, it should be appreciated that the upper surface of the second yoke 5 and the upper surface of the cores 2 are on the same plane.

Next, all the sub assemblies A, B and C are assembled together by a plurality of screws 12. Each screw 12 goes through the hole 11*b* on the guideframe 11, the hole 10*a* on the yoke plate 10, the hole 7*b* on the spring 7, the hole 6*a* on the spacer 6 to the hole hole 5*a* of the second yoke 5. And the screws 12 are engaged with the female screws 5*a* of the second yoke 5 to fix rigidly the sub assembly A and the half assembly B to the sub assembly C.

In assembling the sub assemblies A and B on the magnet assembly C, it should be appreciated that the tops of the print needles 9 must align in the guide slit 11*a* of the guideframe 11. The alignment of said printing needles is performed by utilizing the particular tool as described below.

Figure 6A:
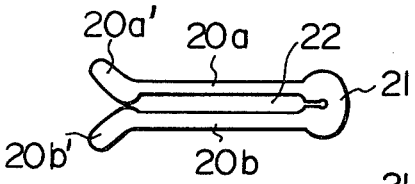
FIGS. 6A–6C show a tool for aligning the print needles.
Figure 6B:
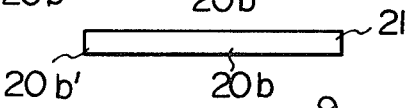
Figure 6C:
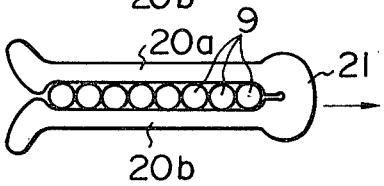

FIG. 6A shows the alignment tool, which looks like a hair pin. The tool has the first and the second linear arms 20*a* and 20*b* folded at the point 21, and that tool is made of resilient or spring material. Preferably, the end of said parallel arms 20*a* and 20*b* is a little opened as shown by 20*a*' and 20*b*', and a narrow elongated space 22 is provided between the arms 20*a* and 20*b*. When the needle assembly B is completed, the printing needles 9 are aligned between the parallel linear arms 20*a* and 20*b* of the tool as shown in FIG. 6C, then, three sub assemblies A, B and C are coupled as described before, and the top of the printing needles are aligned in the guide slit 11*a* of the guideframe 11. After the screws 12 fixes the sub assemblies rigidly, the alignment tool is removed through the opening (side hole) 11*c* which is provided at the side wall of the post 11*e* of the guideframe 11 by pulling the tool with a pliers in the direction of the arrow of FIG. 6B.

Figure 3:
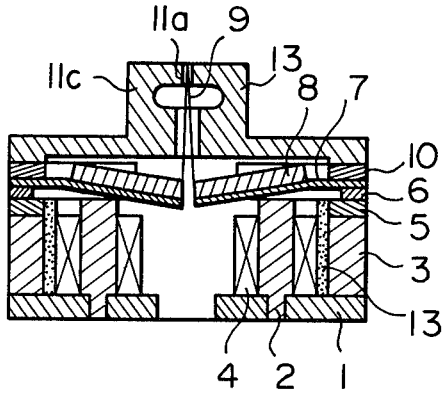
FIG. 3 is the cross sectional view of the printer head according to the present invention.
Figure 2:
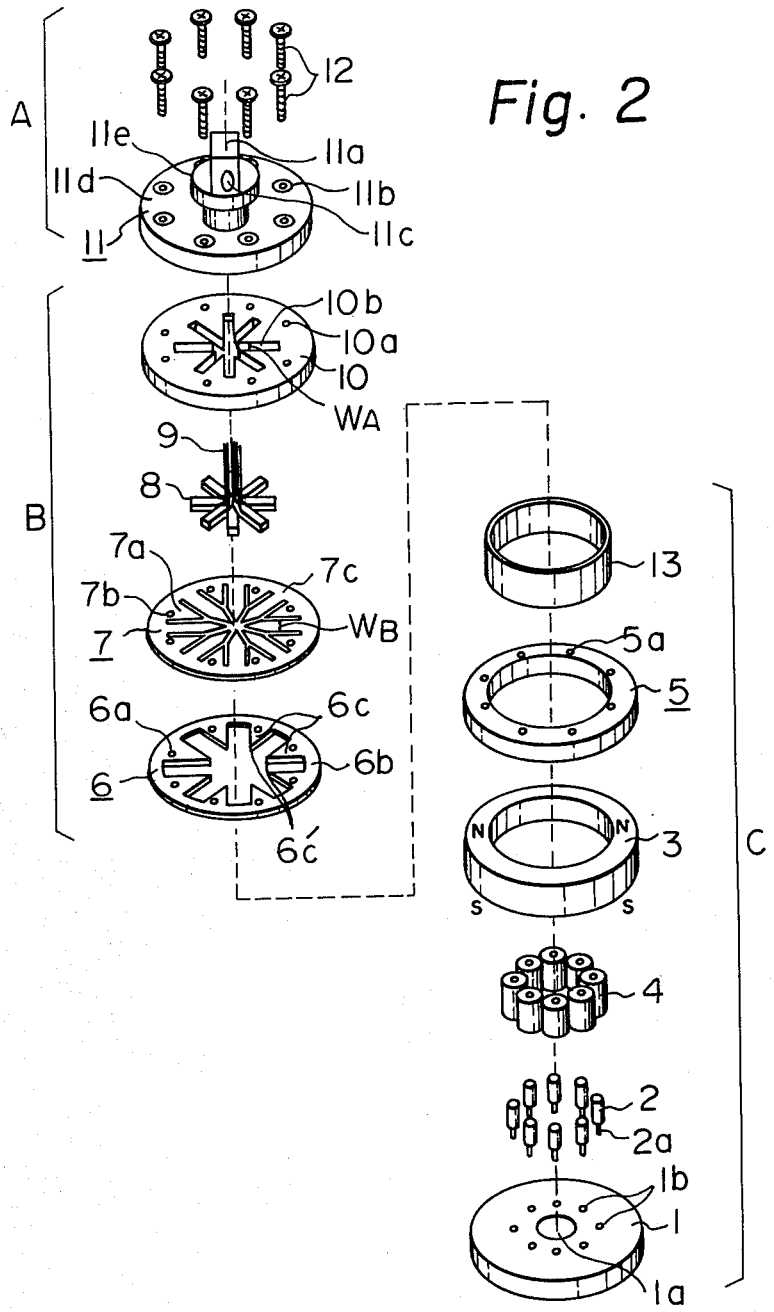
FIG. 2 is the disassembled view of the components of the printer head according to the present invention.
Figure 4D:
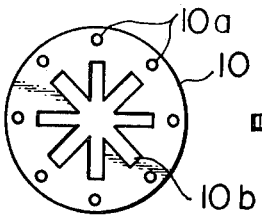
Figure 4D:
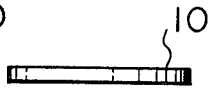
Figure 4D:
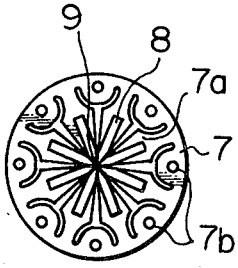
Figure 4D:
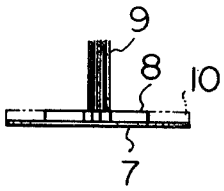
Figure 4D:
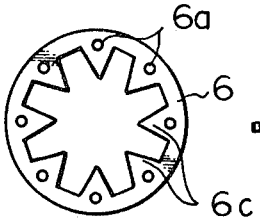
Figure 4D:
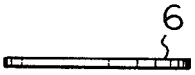
Figure 4D:
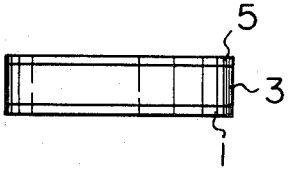
Figure 4E:
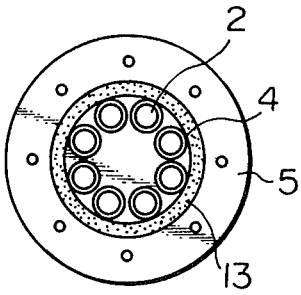
Figure 4F:
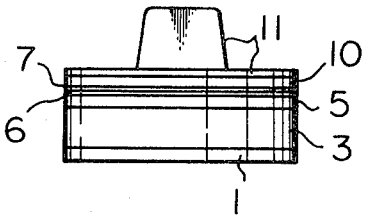
Figure 4G:
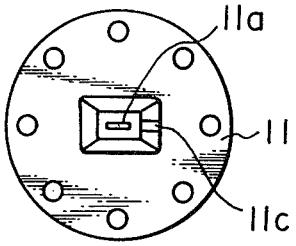

The external appearance of the assembled printing head is shown in FIG. 4F and 4G, and the cross sectional view of the printing head is shown in FIG. 3.

Now, the operation of the present printing head is described in accordance with FIG. 3.

When the coil 4 is not energized, the magnetic flux induced by the cylindrical permanent magnet 3 circulates from the magnet 3, through the second yoke 5, the spacer 6, the spring 7, the yoke plate 10, the armatures 8, the projections 7*a* of the spring 7, the cores 2 and the first yoke 1, to the magnet 3. Therefore, the armatures 8 together with the projections 7*a* of the spring 7, are attracted to the column cores 2 by the force of the permanent magnet 3. Each of the armatures 8 and the projections 7*a* are attracted by the related core independently, and when the armatures are attracted by the cores, the tops of the print needles 9 are secured in the guideframe 11. Therefore, when a coil 4 is not energized, the spring 7 is biased or energized by the permanent magnet.

Next, when one of the coils 4 is energized by flowing the electric current in said coil 4, the related core 2 is magnetized, so that the magnetic flux generated by the coil 4 cancels the magnetic flux of the permanent magnet 3 in said core 4. Therefore, the related armature 8 is not attracted by the core 2 anymore, but is released. When the projection 7*a* of the spring 7 is released, the print needle 9 attached to the armature 8 is forced out of the guideframe 10, and the needle thus pushed strikes a paper through an ink ribbon (not shown), then a dot is printed on a paper. Therefore, a needle is driven by the energy stored in the spring 7 according to the present invention, while a needle of a prior printer is driven by the force of an electromagnet.

Next, when the electric current in the coil 4 stops, the magnetic flux generated by the coil 4 is also stopped and the magnetic flux generated by the permanent 3 is not canceled in the related core 2, then, the armature 8 is attracted again to the core 2. When the armature 8 is attracted to the core 2, the armature 8 does not vibrate and no chattering of a needle occurs as described later.

According to the present printing head, the length between the spring 7 and a core 2 when the related coil 4 is energized, is equal to the thickness of the spacer 6, and the stroke of a print needle 9 is also equal to the thickness of the spacer 6. Therefore, the length of the stroke of a print needle 9, that is to say, the travelling length of a print needle 9 is always constant, and all the print needles 9 can print with the same concentration. Further, since the printing concentration depends upon the thickness of the spacer 6, the printing darkness of a printer is easily controlled by adjusting the thickness of the spacer 6, and so the excellent printing quality is obtained. It should be appreciated of course that the thickness of the spacer 6 can be precisely and accurately controlled in the manufacturing process. Further, since the thickness of the spacer 6 is accurate, the length between the spring 6 and a core 2 is also accurate.

Figure 5A:
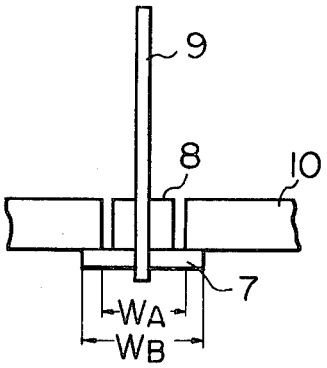
FIG. 5(A) and FIG. 5(B) show the enlarged view of a part of the plate spring and a yoke plate.
Figure 5B:
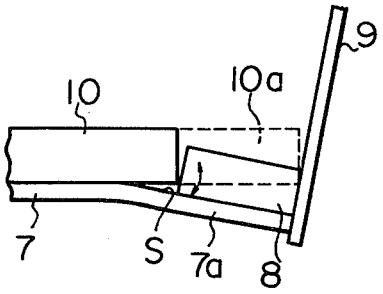

Also, according to the present invention, the width $W_A$ of the slit 10*b* on the yoke plate 10 is narrower than the width $W_B$ of the separated projection 7*a* of the spring 7 as shown in FIG. 5A. Therefore, when a projection 7*a* of the spring 7 is released, both the sides (s) of the projection 7*a* touch to the yoke plate 10, during the movement of the projection 7*a* to the unbiased position (see FIG. 5B). Accordingly, the vibration of the projections 7*a* and/or the spring 7 is absorbed in the yoke plate 10, and the movement of the spring 7 is conveniently damped. The damping effect for the spring 7 facilitates the increase in the printing speed of the printer.

Further, the presence of the oil felt 13 is one of the features of the present invention. The coil contained in the oil felt 13 is provided to the spacer 6, the spring 7 and the yoke plate 10 through the inner surface of the permanent magnet 3 and the second yoke 5. Therefore, the friction in the movement of said spring 7 is reduced. The reduction of the friction provides the decrease of the wear of the components, and the high speed operation of the printer. Further, it should be noted that the spacer 6 has the projections 6*c*, and the top 6*c*' of the projections 6*c* extends beyond the inner surfaces of the magnet 3 and the second yoke 5, therefore, said top 6*c*' covers the oil felt 13, thus, the oil felt 13 is prevented from going out of the magnet 3. Therefore, the oil felt 13 never touches the spring 7, and thus, the operation of the spring 7 is not disturbed by the oil felt 13.

Finally, the numerical embodiment of the present printer head is described.

When the size of a character to be printed is 2.67 mm×2.05 mm, the number of dots is seven. In this case, preferably, the number of print needles 9 is eight, for seven dots of character to be printed and one dot for providing an underline under the printed dot when said underline requested. Therefore, the number of projections and the electromagnets is also eight.

The diameter of a print needle 9 is 0.36 mm, and that needle is made of a hard steel including tungsten and cobalt. The permanent magnet 3 has 35 mm of the outer diameter, 22 mm of the inner diameter, and 8 mm of the height, and that magnet is made of ferrite material. The column core 2 of an electromagnet has 3.5 mm of diameter and is made of silicon steel. The coil 4 wound on that column core 2 is an enameled wire of 0.1 mm, and has 490 turns. The electric current applied to that coil is 1 ampere. The disk spring 7 is made of carbon steel for a spring material. The length of a stroke of a print needle is 0.6 mm at the top of a needle, and is 0.4 mm at the portion of the projection of the disk spring.

According to the structure of the present printer head, the present invention has the advantages that the size of the apparatus is small, the power consumption consumed in a coil 4 is small, and the printing speed is high. The printing speed up to 120 characters every second is possible. Further, since the strike action or the movement of a print needle is actuated by a disk spring, the pressure by a needle is always constant irrespective to the change of the electric current applied to a coil, then, the excellent print quality is obtained.

Further, it should be appreciated that the present printer head is suitable for the use of a keyboard printer, which has a manual keyboard for the input of characters, since the present printer head is utilized in a serial printer.

From the foregoing, it will now be apparent that a new and improved printer head has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A printer head comprising:

a cylindrical permanent magnet;

a first yoke covering the bottom of said magnet;

n number of electromagnets, each having a center core and a coil wound around the core, positioned in a circle on said first yoke with predetermined angle intervals therebetween;

a disc-shaped spring having an outer ring and n number of projections projecting towards the center of said outer ring;

n number of elongated armatures, each positioned on one of the projections of said disc spring;

n number of print needles, each fixed to one of said armatures perpendicular to the plane of the disc spring wherein each of said needles is straight;

a ring-shaped spacer positioned between said disc spring and said cylindrical permanent magnet;

a second circular yoke fixed on said disc spring for providing a magnetic flux path between the permanent magnet and each of said electromagnets, said second circular yoke having radial slits for receiving said armatures;

a guideframe including a first portion having a thin linear slit for receiving the tops of said print needles wherein said guideframe covers the print needles;

said guideframe having a side hole means in a side wall of the first portion of the guideframe for receiving a tool for aligning the print needles, said tool having a pair of parallel linear arms with projections at the extreme ends thereof such that the arms contact each other at the projections with a spring action, and hold said print needles in a straight line between the parallel arms thereof; and a cylindical oil felt means attached on the inner cylindrical surface of said permanent magnet coaxial therewith for providing lubrication between the spring and the core.

2. A printer head according to claim 1 wherein said guide frame is made of plastics reinforced by glass fiber.

3. A printer head according to claim 1 wherein said spacer has a plurality of projection means projecting radially inward from the ring for covering at least a portion of the oil felt means, thereby maintaining said oil felt means in its position.

* * * * *